US008727332B2

(12) United States Patent
Huang

(10) Patent No.: US 8,727,332 B2
(45) Date of Patent: May 20, 2014

(54) PERIPHERAL DEVICE AND SHEET FEEDING METHOD

(75) Inventor: Ying-Chieh Huang, New Taipei (TW)

(73) Assignees: Cal-Comp Electronics & Communications Company Limited, New Taipei (TW); Kinpo Electronics, Inc., New Taipei (TW)

( * ) Notice: Subject to any disclaimer, the term of this patent is extended or adjusted under 35 U.S.C. 154(b) by 0 days.

(21) Appl. No.: 13/615,617

(22) Filed: Sep. 14, 2012

(65) Prior Publication Data

US 2013/0307208 A1 Nov. 21, 2013

(30) Foreign Application Priority Data

May 15, 2012 (TW) ..... 101117249

(51) Int. Cl.
*B65H 83/00* (2006.01)

(52) U.S. Cl.
USPC ..... 271/3.14; 271/186

(58) Field of Classification Search
USPC ..... 271/186, 65, 301, 291, 3.18, 4.01, 4.04, 271/4.1, 10.01, 10.04, 10.11; 399/364
See application file for complete search history.

(56) References Cited

U.S. PATENT DOCUMENTS

| | | | | |
|---|---|---|---|---|
| 6,942,215 | B2 * | 9/2005 | Kang et al. | 271/265.01 |
| 7,306,216 | B2 * | 12/2007 | Lee et al. | 271/10.01 |
| 7,717,423 | B2 | 5/2010 | Litman et al. | |
| 7,793,927 | B2 | 9/2010 | Lin | |
| 7,832,722 | B1 | 11/2010 | Huang | |
| 7,926,801 | B2 | 4/2011 | Lin | |
| 8,006,974 | B2 | 8/2011 | Hsiao | |
| 8,556,256 | B2 * | 10/2013 | Ito | 271/186 |
| 2009/0166944 | A1 | 7/2009 | Bahrami et al. | |
| 2010/0295234 | A1 | 11/2010 | Liu | |

* cited by examiner

*Primary Examiner* — Michael McCullough
(74) *Attorney, Agent, or Firm* — Jianq Chyun IP Office

(57) ABSTRACT

A peripheral device includes a body, a carriage, a first feeding assembly, and a second feeding assembly. The carriage and the first and second feeding assemblies are assembled to the body. The first and second feeding assemblies are located at the same side of the body. The carriage moves back and forth along an axial direction. A portion of the first feeding assembly is located on a moving path of the carriage. The first feeding assembly is removably coupled to the second feeding assembly. The first feeding assembly drives the second feeding assembly to move a printing medium into or out of the body. When the carriage is moved to one side of the body, the carriage moves the first feeding assembly away from the second feeding assembly, such that the printing medium is fed into or moved out of the body only by the first feeding assembly.

13 Claims, 10 Drawing Sheets

PERIPHERAL DEVICE AND SHEET FEEDING METHOD

CROSS-REFERENCE TO RELATED APPLICATION

This application claims the priority benefit of Taiwan application serial no. 101117249, filed on May 15, 2012. The entirety of the above-mentioned patent application is hereby incorporated by reference herein and made a part of this specification.

BACKGROUND OF THE INVENTION

1. Field of the Invention

The invention relates to a peripheral device and a sheet feeding method applied to the peripheral device. More particularly, the invention relates to a peripheral device capable of printing on both sides of a printing medium and a sheet feeding method applied to the peripheral device.

2. Description of Related Art

As the information technology advances, office automation (OA) equipment including scanners, photocopiers, or printers is often placed in offices, and thus users may perform secretarial processing operations with use of these OA equipment. Note that the above-mentioned OA equipment in the office consumes a lot of space. As a result, a multi-function peripheral (MFP) integrated with functions of copying, printing, and scanning has been developed to resolve said problem.

In a conventional MPF as described above, a double-side sheet feeding module is required to flip the paper over if both sides of the paper are to be printed or scanned. The additional sheet feeding module however leads to both an increase in costs of the OA equipment and a decrease in operation efficiency.

SUMMARY OF THE INVENTION

The invention is directed to a peripheral device capable of printing on both sides of a printing medium.

The invention is further directed to a sheet feeding method for printing on both sides of a printing medium.

In an embodiment of the invention, a peripheral device that includes a body, a carriage, a first feeding assembly, and a second feeding assembly is provided. The carriage is assembled to the body and moved back and forth along an axial direction. The first feeding assembly and the second feeding assembly are disposed at the same side of the body. A portion of the first feeding assembly is located on a moving path of the carriage. Besides, the first feeding assembly is removably coupled to the second feeding assembly and drives the second feeding assembly to move a printing medium into or out of the body. When the carriage is moved to the side of the body, the carriage moves the first feeding assembly away from the second feeding assembly, such that the printing medium is fed into or moved out of the body simply by the first feeding assembly.

In an embodiment of the invention, a sheet feeding method suitable for a peripheral device is provided to print on both sides of a printing medium. The peripheral device includes a body, a carriage, a first feeding assembly, and a second feeding assembly. The carriage, the first feeding assembly, and the second feeding assembly are assembled to the body. The carriage is moved back and forth along an axial direction. The first feeding assembly and the second feeding assembly are disposed at a side of the body. The first feeding assembly is removably coupled to the second feeding assembly. The sheet feeding method includes moving the carriage to the side of the body, such that the carriage is driven to the first feeding assembly away from the second feeding assembly.

According to an embodiment of the invention, the first feeding assembly includes a first gear set and a swinging element pivoted to the body respectively. The second feeding assembly includes a second gear set that is pivoted to the body. The swinging element at least partially interferes with a side surface of the first gear set. The first gear set rotates to swing the swinging element in a first direction, and the swung swinging element is coupled to the second gear set and rotates the second gear set.

According to an embodiment of the invention, the first feeding assembly further includes a clutch element pivoted to the body. The clutch element has a first propping end and a leaning end opposite to each other. The swinging element has a first arm extending toward the clutch element. The first propping end is located on the moving path of the carriage. The first arm slidably leans against the leaning end. When the carriage is moved to the side of the body, the carriage props the first propping end, such that the leaning end lifts the first arm and rotates the swinging element in a second direction, and that the first gear set is moved away from the second gear set. Here, the first direction is opposite to the second direction.

According to an embodiment of the invention, the clutch element and the swinging element are rotated in the same direction.

According to an embodiment of the invention, the peripheral device further includes a door movably disposed at an inlet of the body. The door is partially located on a moving path of the leaning end. The clutch element is rotated in the second direction to drive the door to open or close the inlet.

According to an embodiment of the invention, the swinging element has a second propping end away from the second feeding assembly, and the second propping end is located on the moving path of the carriage. When the carriage is moved to the side of the body, the carriage props the second propping end to rotate the swinging element in a second direction, and the swinging element moves the first gear set away from the second gear set. Here, the first direction is opposite to the second direction.

According to an embodiment of the invention, the peripheral device further includes a door and an elastic element. The door is movably disposed at an inlet of the body. The elastic element is connected between the door and the body, and the elastic element drives the door to close the inlet.

According to an embodiment of the invention, the door has a sliding slot located at the side of the body. The swinging element further has a second arm opposite to the second propping end, and the second arm is slidably coupled to the sliding slot. When the swinging element is rotated in the first direction, the second arm is moved to an end of the sliding slot and props the door, such that the door opens the inlet. When the swinging element is rotated in the second direction, the second arm is moved away from the end of the sliding slot and releases the door, such that the door is driven by the elastic element to close the inlet.

According to an embodiment of the invention, the peripheral device further includes a feed-back tray and a third feeding assembly. The feed-back tray is detachably assembled to the body. The third feeding assembly is assembled to the body and is adjacent to the feed-back tray. The printing medium is driven merely by the first feeding assembly and transferred from the body back to the feed-back tray. The third feeding assembly assists the printing medium in moving within the feed-back tray.

According to an embodiment of the invention, the peripheral device further includes a printing unit and a feed-back tray. The printing unit is configured on the carriage. The feed-back tray is detachably assembled to the body. The first feeding assembly includes a first gear set pivoted to the body, a swinging element, and a printing roller connected to the first gear set. The second feeding assembly includes a second rear set pivoted to the body and a pickup roller connected to the second gear set. The swinging element partially interferes with a side surface of the first gear set. The sheet feeding method further includes rotating the first gear set to swing the swinging element toward the second gear set, such that the first gear set is coupled to the second gear set and drives the second gear set, and that the pickup roller is driven to feed the printing medium into the body. The first gear set is rotated, and simultaneously the carriage and the printing unit are driven to drive the printing roller, such that the printing roller is driven to transfer the printing medium, and that the printing unit prints on a first surface of the printing medium. After the carriage moves the first feeding assembly away from the second feeding assembly, the first gear set is rotated to move the printing medium through the body, the feed-back tray, and the body, such that a second surface of the printing medium faces the printing unit, and that the first surface is opposite to the second surface. After the first feeding assembly is coupled to the second feeding assembly, the printing unit is driven to print on the second surface. The first feeding assembly and the second feeding assembly are driven to move the printing medium out of the body.

According to an embodiment of the invention, the first feeding assembly further includes a clutch element pivoted to the body. The clutch element has a first propping end and a leaning end opposite to each other. The swinging element has a first arm extending toward the clutch element. The first propping end is located on the moving path of the carriage. The first arm slidably leans against the leaning end. The sheet feeding method further includes moving the carriage to the side of the body and propping the first propping end of the clutch, such that the leaning end rotates the first arm in the second direction, and that the swinging element of the first gear set is moved away from the second gear set.

According to an embodiment of the invention, the peripheral device further includes a door movably disposed at an inlet of the body. The door is partially located on a moving path of the leaning end. The sheet feeding method further includes driving the door by the leaning end to open or close the inlet when the leaning end rotates the first arm in the second direction.

According to an embodiment of the invention, the swinging element has a second propping end located on the moving path of the carriage. The sheet feeding method further includes moving the carriage to the side of the body and propping the second propping end of the swinging element to rotate the swinging element in the second direction, such that the first gear set is moved away from the second gear set.

According to an embodiment of the invention, the peripheral device further includes a door and an elastic element. The door is movably disposed at an inlet of the body and is partially located on a moving path of the swinging element. The elastic element is connected between the door and the body, and the elastic element drives the door to close the inlet. The sheet feeding method further includes driving the first gear set to rotate the swinging element in the first direction, such that the swinging element drives the door to open or close the inlet. The first gear set is driven to rotate the swinging element in the second direction, such that the swinging element drives the door to close or open the inlet As provided in the previous embodiments of the invention, before the carriage performs a printing job, the carriage is moved, such that the peripheral device can be shifted between a coupling mode and a non-coupling mode (whether the first and second feeding assemblies are coupled or not) and can perform a feed-back job. Thereby, the double-side printing job can be completed with the existing components in no need of configuring other feed-back mechanisms. As a result, the operation efficiency of the OA equipment can be enhanced, and the manufacturing costs of the OA equipment can be reduced due to the simplified structure.

Other features and advantages of the invention will be further understood from the further technological features disclosed by the embodiments of the invention wherein there are shown and described preferred embodiments of this invention, simply by way of illustration of modes best suited to carry out the invention.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the invention.

DESCRIPTION OF EMBODIMENTS

Figure 1:
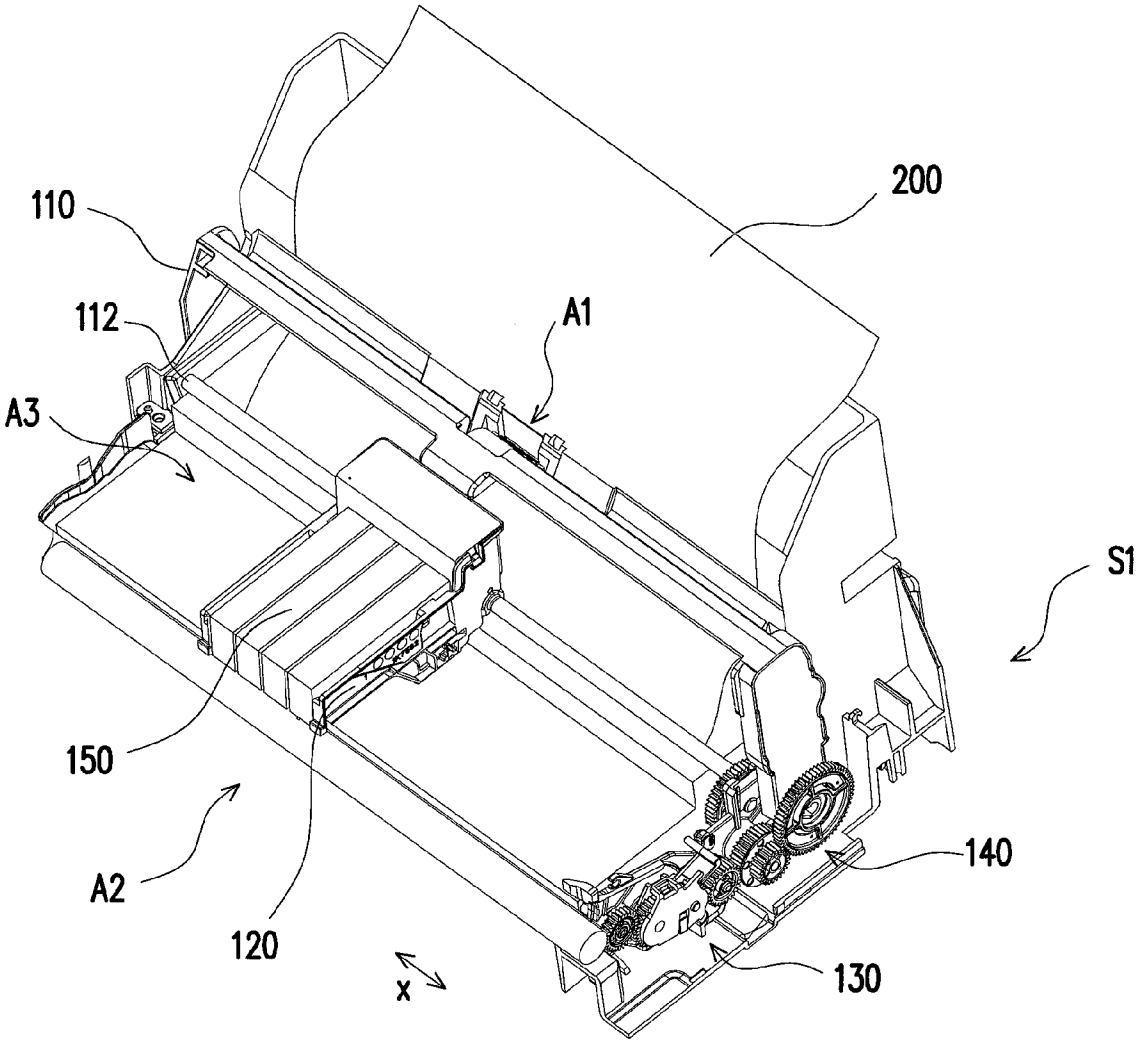
FIG. 1 and FIG. 2 are schematic views illustrating a peripheral device according to an embodiment of the invention.
Figure 2:
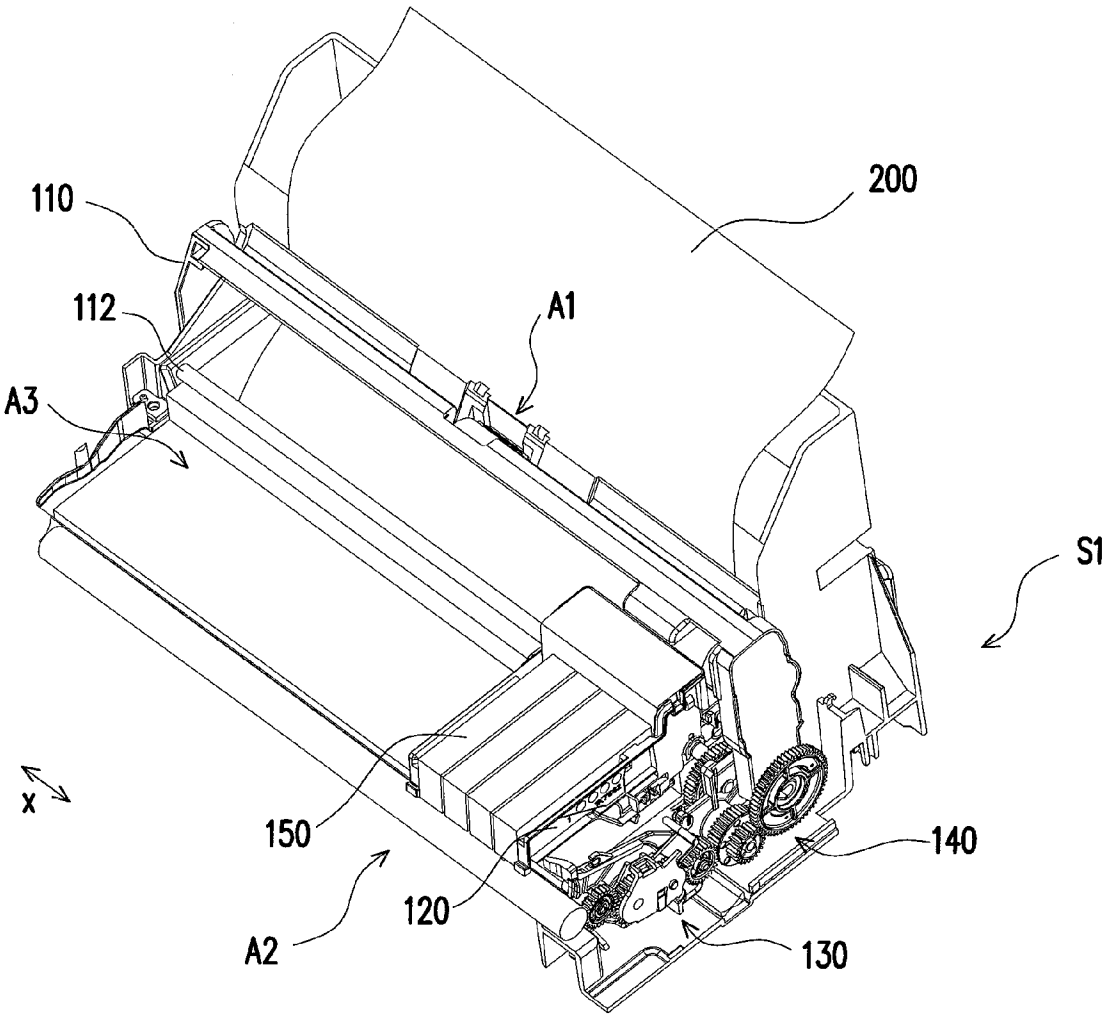
Figure 3:
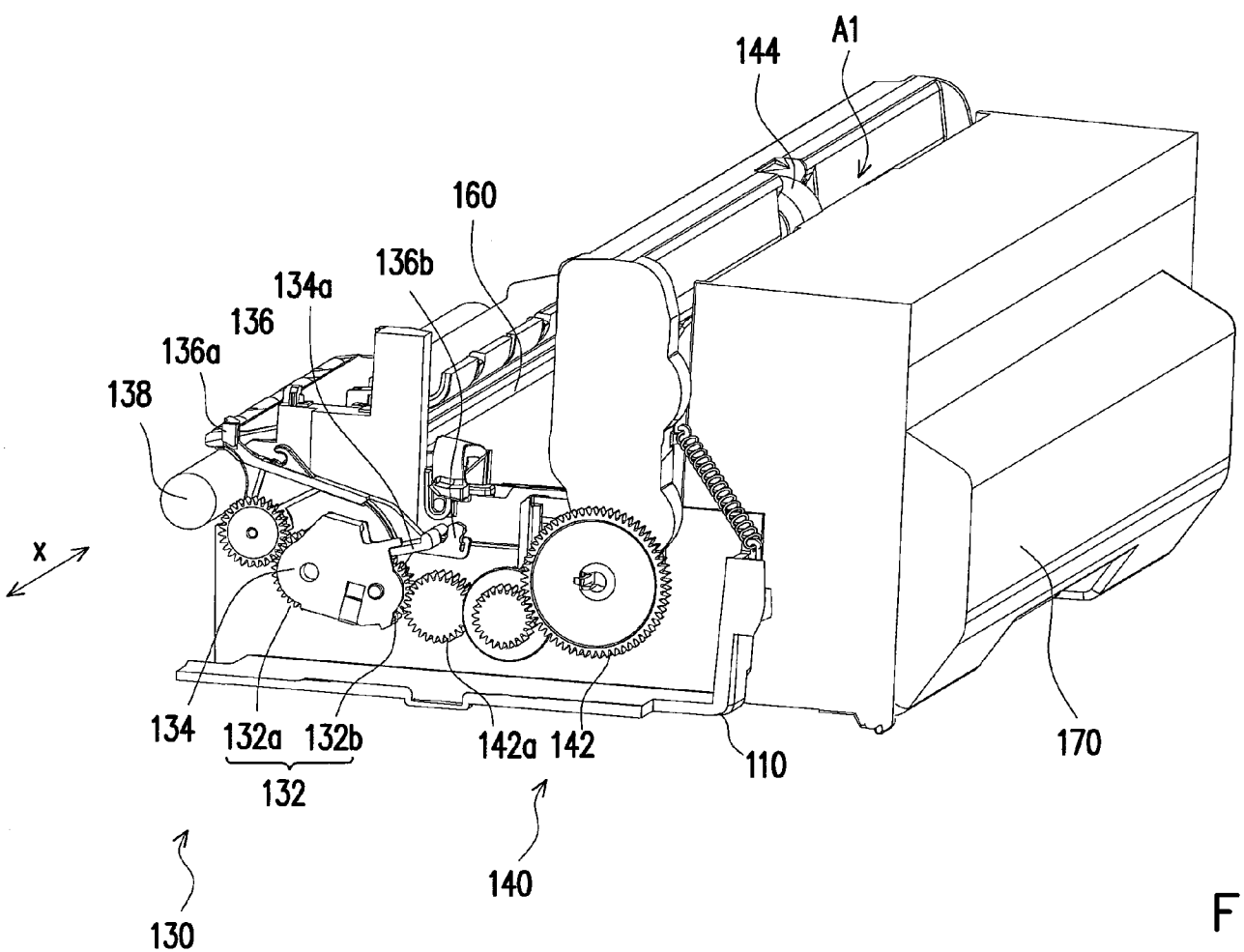
FIG. 3 is a schematic view illustrating an inner structure of the peripheral device depicted in FIG. 1 at another viewing angle.

FIG. 1 and FIG. 2 are schematic views illustrating a peripheral device according to an embodiment of the invention. The carriage described in FIG. 1 and FIG. 2 is at different locations to represent different states of the peripheral device. FIG. 3 is a schematic view illustrating an inner structure of the peripheral device depicted in FIG. 1 at another viewing angle. To clearly illustrate the relative relations among the components in the embodiment, some elements depicted in the peripheral device shown in FIG. 1 and FIG. 2 are omitted in FIG. 3. With reference to FIG. 1 to FIG. 3, in the present embodiment, the peripheral device 100 includes a body 110, a carriage 120, a first feeding assembly 130, and a second feeding assembly 140. The body 110 has an inlet A1, an outlet A2, and a printing zone A3 located between the inlet A1 and the outlet A2. The carriage 120 is assembled onto a guiding shaft 112 at the printing zone A3 and moved back and forth along an axial direction X, and a printing unit 150 is assembled to the carriage 120. When a printing medium 200 (e.g., a piece of paper, a business card, etc., which should not be construed as a limitation to the invention) is moved to the printing zone A3 in the body 110 via the inlet A1, the printing unit 150, together with the carriage 120, is moved back and forth along the axial direction X and performs a printing job on the printing medium 200 in the printing zone A3.

In the present embodiment, the exemplary printing function of the peripheral device 100 is described, which should however not be construed as a limitation to the invention. Any image processing job (e.g., an image scanning job and the aforesaid printing job) that can be correspondingly performed on the printing medium fed into the body 110 through the carriage 120 is applicable according to the invention.

Figure 4:
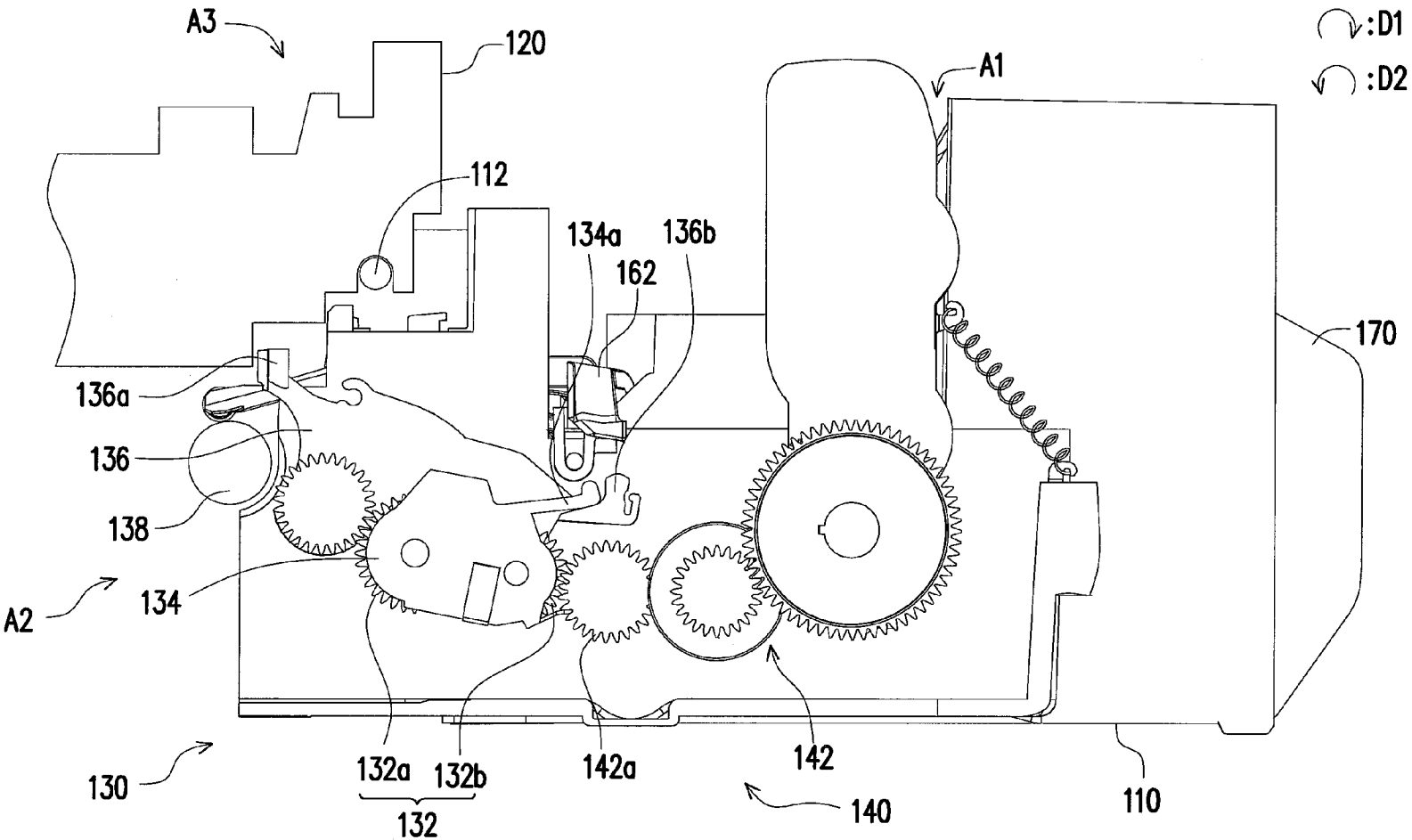
FIG. 4 and FIG. 5 are side views illustrating the peripheral device in FIG. 1 and the peripheral device in FIG. 2 respectively in different states.
Figure 5:
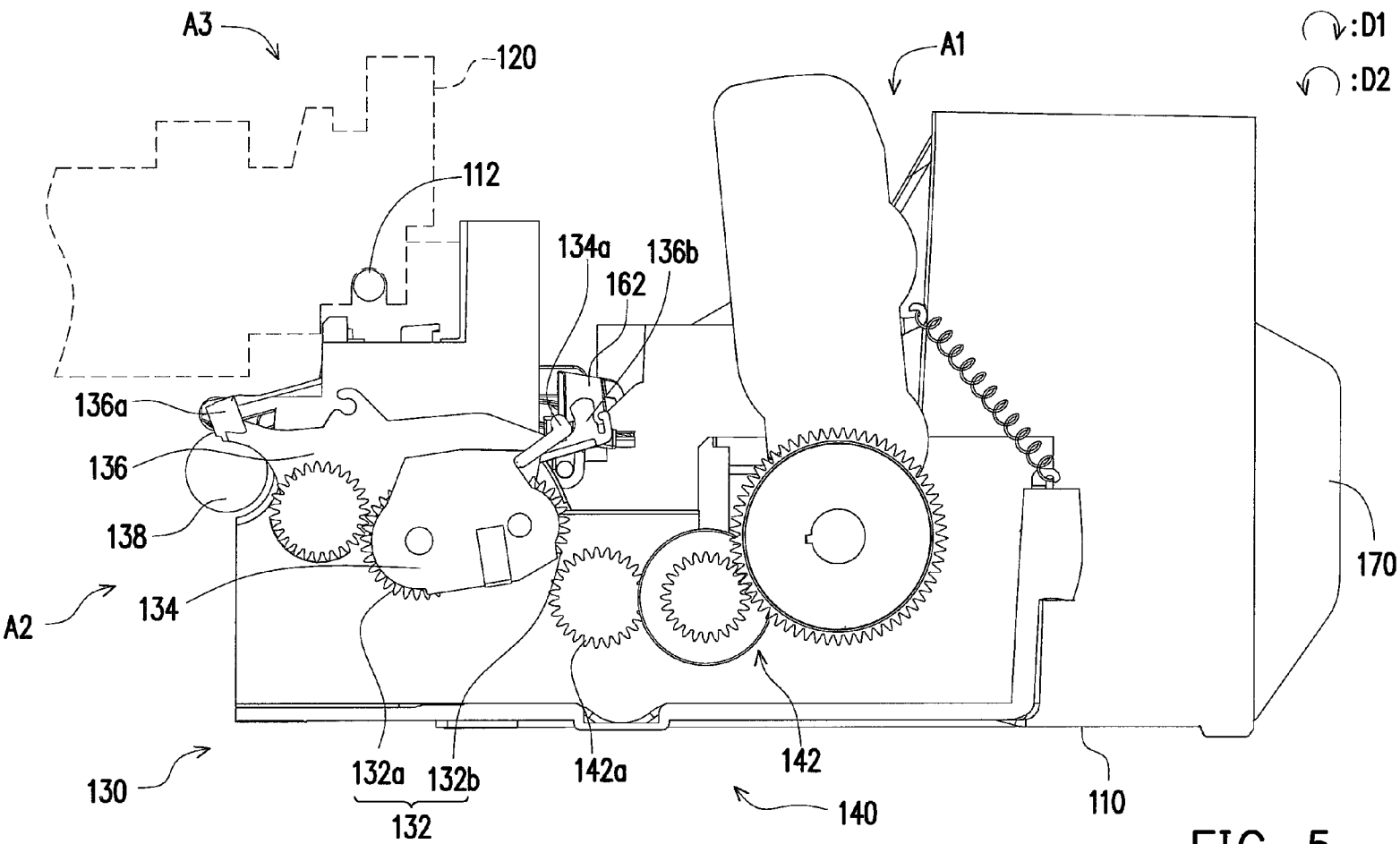

FIG. 4 and FIG. 5 are side views illustrating the peripheral device in FIG. 1 and the peripheral device in FIG. 2 respectively in different states. Different profiles of the carriage 120 are respectively shown in FIG. 4 and FIG. 5, such that the carriage 120 with the profile shown by solid lines is in the state depicted in FIG. 1, and that the carriage 120 with the profile shown by dotted lines is in the state depicted in FIG. 2. Please refer to FIG. 1 to FIG. 5. In the present embodiment, the first feeding assembly 130 and the second feeding assembly 140 are located at the same side of the body 110 (e.g., the right side S1 shown in FIG. 1 and FIG. 2, which should not be construed as a limitation to the invention), and a portion of the first feeding assembly 130 is located on a moving path of the carriage 120. That is, a portion of the first feeding assembly 130 extends toward the printing zone A3 and intersects with the moving path of the carriage 120, and the first feeding assembly 130 is removably coupled to the second feeding assembly 140.

Thereby, when the first feeding assembly 130 is coupled to the second feeding assembly 140, the printing medium 200 can be fed into the printing zone A3 in the body 110 via the inlet A1 because the first and second feeding assemblies 130 and 140 are both driven, and the printing job can be performed until the printing medium 200 is moved out of the body 110 via the outlet A2. At this time, the carriage 120 is shown by solid lines in FIG. 4 to represent that the carriage 120 does not interfere with the first feeding assembly 130. When the carriage 120 and the printing unit 150 thereon stop performing the corresponding printing job on the printing medium 200 and are moved to the right side S1 of the body 110 where the first feeding assembly 130 is located, the carriage 120 is shown in FIG. 2 and interferes with the first feeding assembly 130, so that the first feeding assembly 130 is driven to move away from the second feeding assembly 140. Thereby, the printing medium 200 is fed into or moved out of the body 110 merely by the first feeding assembly 130.

Here, the locations of the first and second feeding assemblies 130 and 140 on the body 110 are not limited; namely, the invention is applicable if the carriage 120 is moved to a predetermined location where the printing unit 150 is driven not to perform the printing job (or any relevant image processing job) and where the first and second feeding assemblies 130 and 140 are correspondingly placed, and the first feeding assembly 130 is moved away from the second feeding assembly 140 when the carriage 120 is moved to the predetermined location.

To be more specific, as shown in FIG. 3 to FIG. 5, the first feeding assembly 130 includes a first gear set 132 and a swinging element 134. The first gear set 132 is pivoted to the body 110 and includes a plurality of gears in the present embodiment. In the drawings, only some of the gears are marked as 132. The swinging element 134 is a plate and at least partially interferes with a side surface of the first gear set 132. It can be regarded that the swinging element 134 is interfered with one gear of the first gear set 132. The second feeding assembly 140 includes a second gear set 142 that has a plurality of gears in the present embodiment. In the drawings, only one gear is marked. The second gear set 142 is located corresponding to the swinging element 134 on the body 110, and at least one gear of the second gear set 142 is located on a swinging path of the swinging element 134. Accordingly, when the first gear set 132 receives power from a power source (not shown) and is then rotated, the friction force between the first gear set 132 and the swinging element 134 results in the swinging motion of the swinging element 134 in a first direction D1 (shown in FIG. 4), and the first gear set 132 is correspondingly swung and coupled to the second gear set 142. Thereby, the power is allowed to be transmitted from the first feeding assembly 130 to the second feeding assembly 140.

For instance, the first gear set 132 includes an active gear 132*a* and a joining gear 132*b*, and the swinging element 134 interferes with the side surface of the active gear 132*a*. Hence, when the active gear 132*a* receives the power and is then rotated in the first direction D1, the swinging element 134 is correspondingly rotated in the first direction D1, and the joining gear 132*b* is swung together with the swinging element 134 and joins one gear 142*a* of the second gear set 142. As such, on the condition that the first gear set 132 is coupled to the second gear set 145, the power can be transmitted from the first feeding assembly 130 to the second feeding assembly 140. Note that the configuration of gears is not limited in the embodiment, and the invention is applicable as long as the first gear set 132 and the second gear set 142 can be coupled or not coupled to each other as described above.

The first feeding assembly 130 further includes a clutch element 136 pivoted to the body 110. The clutch element 136 has a first propping end 136*a* and a leaning end 136*b* opposite to each other. Here, the first propping end 136*a* (i.e., the portion of the first feeding assembly 130 extending to the printing zone A3) is located on the moving path of the carriage 120 along the axial direction X, and the leaning end 136*b* is located adjacent to the second feeding assembly 140, so that the clutch element 136 can be a lever structure. The swinging element 134 has a first arm 134*a* extending toward the clutch element 136, and the first arm 134*a* slidably leans against the leaning end 136*b* of the clutch element 136, such that the swinging element 134 and the clutch element 136 can be rotated in the same direction.

In the present embodiment, the first propping end 136*a* is substantially a forward protrusion extending toward the carriage 120. Thereby, when the carriage 120 is moved to the right side S1 of the body 110, the carriage 120 props the first propping end 136*a* to rotate the leaning end 136*b* of the clutch element 136 in a second direction D2 (shown in FIG. 5), and the first arm 134*a* on the leaning end 136*b* can be lifted. Thereby, the swinging element 134 driven by the clutch element 136 can be moved away from the second gear set 142, and thus the first feeding assembly 130 and the second feeding assembly 140 are not coupled to each other. At this time, the power is merely transmitted to the first feeding assembly 130, and the printing medium 200 is simply driven by the first feeding assembly 130 and is then fed into or moved out of the body 110.

Figure 6:
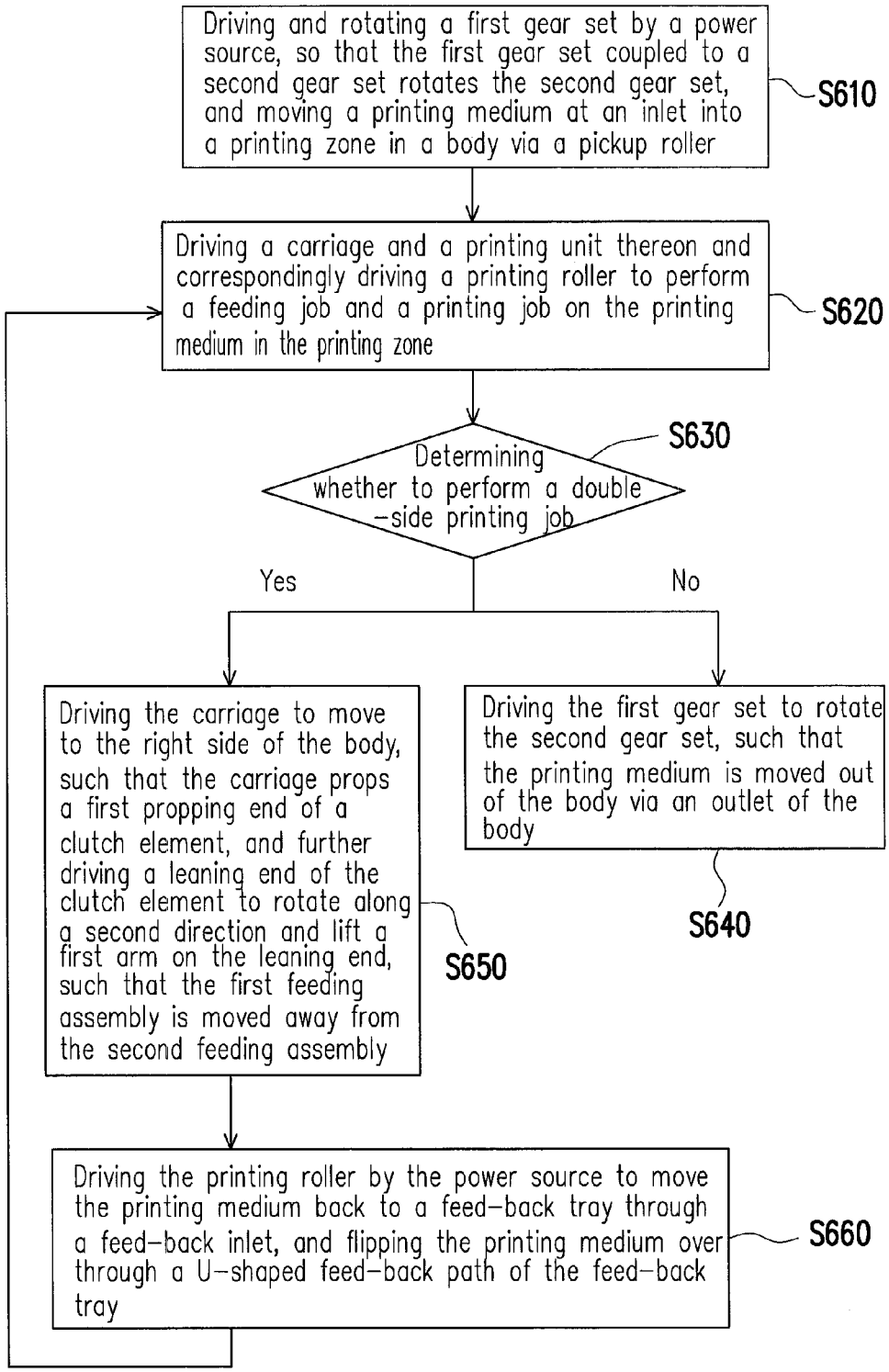
FIG. 6 is a flow chart illustrating a sheet feeding method according to an embodiment of the invention.
Figure 7:
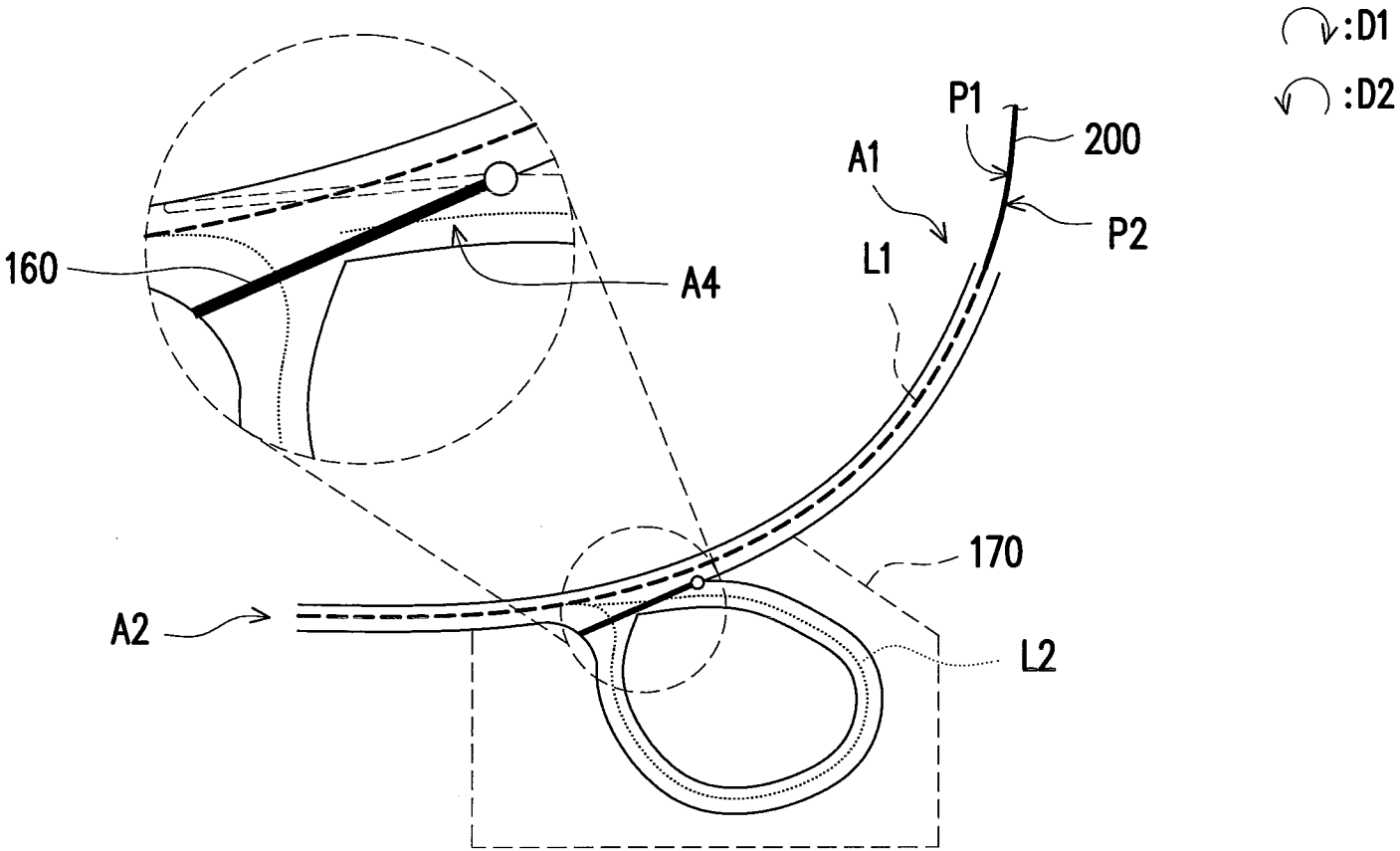
FIG. 7 is a schematic view illustrating a feeding path of the peripheral device depicted in FIG. 2.

FIG. 6 is a flow chart illustrating a sheet feeding method according to an embodiment of the invention. The sheet feeding method is suitable for the peripheral device 100 described in the previous embodiments. FIG. 7 is a schematic view illustrating a feeding path of the peripheral device depicted in FIG. 2. With reference to FIG. 2 and FIG. 4 to FIG. 7, in the present embodiment, the first feeding assembly 130 further includes a printing roller 138 located in the printing zone A3, and the printing roller 138 and the first gear set 132 are commonly coupled to the same power source (e.g., a motor, not shown in the drawings). The second feeding assembly 140 further includes a pickup roller 144 located at the inlet A1 and coupled to the second gear set 142.

In step S610, the first gear set 132 is coupled to the second gear set 142 and is thus driven and rotated by the power source, such that the first gear set 132 rotates the second gear set 142 and moves the printing medium 200 at the inlet A1 into the printing zone A3 in the body 110 via the pickup roller 144. In step S620, the carriage 120 and the printing unit 150 thereon are driven, and the printing roller 138 is correspondingly driven, so as to perform a feeding job and a printing job on the printing medium 200 in the printing zone A3.

It should be mentioned that the gear sets are rotated in different rotation directions according to the present embodiment. Namely, in step S610, the printing medium 200 is picked up and aligned with the gear set being rotated in a backward direction, and the printing medium 200 is fed and printed with the gear set being rotated in a forward direction. Note that the proper gear structure and the way to drive the gear sets can be designed based on actual requirements.

After the printing job is done, whether to perform a double-side printing job is determined in step S630. If not, in step S640, the first gear set 132 is driven to rotate the second gear set 142, such that the printing medium 200 is continuously moved out of the body 110 via the outlet A2 in the manner described in step S620. Namely, the printing medium 200 is fed into or moved out of the peripheral device 100 along a path L1.

The body 110 further has a feed-back inlet A4, and the peripheral device 100 further includes a feed-back tray 170 detachably assembled to the feed-back inlet A4 of the body 110. Thereby, when the double-side printing job is to be performed on the printing medium 200 (after the printing unit 150 prints on the first surface P1 and the double-side printing job is determined to be performed in the steps S620 and S630), the carriage 120 is driven to move to the right side S1 of the body in step S650, such that the carriage 120 props the first propping end 136*a* of the clutch element 136 and further drives the leaning end 136*b* of the clutch element 136 to rotate in the second direction D2 and lift the first arm 134*a* on the leaning end 136*b*. As such, the first feeding assembly 130 is moved away from the second feeding assembly 140, and the printing medium 200 at this time can merely be driven by the first feeding assembly 130.

It should be mentioned that the peripheral device 100 of the present embodiment further includes a door 160 that is movably pivoted to the body 110. The door 160 has a pushing portion 162 which is located at the right side S1 of the body 110 and on a moving path of the leaning end 136*b* of the clutch element 136. When the leaning end 136*b* is rotated in the second direction D2 in the step S650, the door 160 is correspondingly rotated in the first direction D1 (i.e., rotated from the position shown by solid lines to the position shown by dotted lines in FIG. 7). In other words, the leaning end 136*b* and the pushing portion 162 (an end of the door 160 away from the pivot) are located on two arc-shaped intersecting paths, respectively. When the clutch element 136 moves the first gear set 132 away from the second gear set 142, the door 160 is driven to close the inlet A1; therefore, other printing media 200 that are still located at the inlet A1 can no longer be fed into the body 110, and subsequent steps can then be performed. In the present embodiment, the door 160 is substantially movably configured between the inlet A1 and the feed-back inlet A4. Hence, when the door 160 is rotated together with the clutch element 136 and closes the inlet A1 in step S650, the door 160 simultaneously opens the feed-back inlet A4. Thereby, the printing medium 200 would be fed back to the feed-back tray 170 but not be fed back along a wrong path toward the inlet A1.

Note that the rotation direction of the clutch element 136 and the corresponding rotation direction of the door 160 for opening or closing the inlet A1 are not limited in the present embodiment. Through mechanical design, the door 160 opening or closing the inlet A1 may be rotated in a direction opposite to the rotation direction of the clutch element 136.

In step S660, the printing roller 136 is driven by the power source and is then rolled in a reverse direction, so as to move the printing medium 200 back to the feed-back tray 170 through the feed-back inlet A4 and flip the printing medium 200 over through a U-shaped feed-back path (e.g., the path L2 shown in FIG. 7) of the feed-back tray 170. Since the first feeding assembly 130 here is moved away from the second feeding assembly 140, the reverse rolling of the first gear set 132 does not lead to power transmission to the second gear set 142 and the pickup roller 144, and the printing medium 200 will not encounter the paper jam issue. As such, when the first feeding assembly 130 is not coupled to the second feeding assembly 140, the printing medium 200 is flipped over simply by the first feeding assembly 130, such that the second surface P2 opposite to the first surface P1 can be moved into the printing zone A3 and be correspondingly printed.

Figure 8:
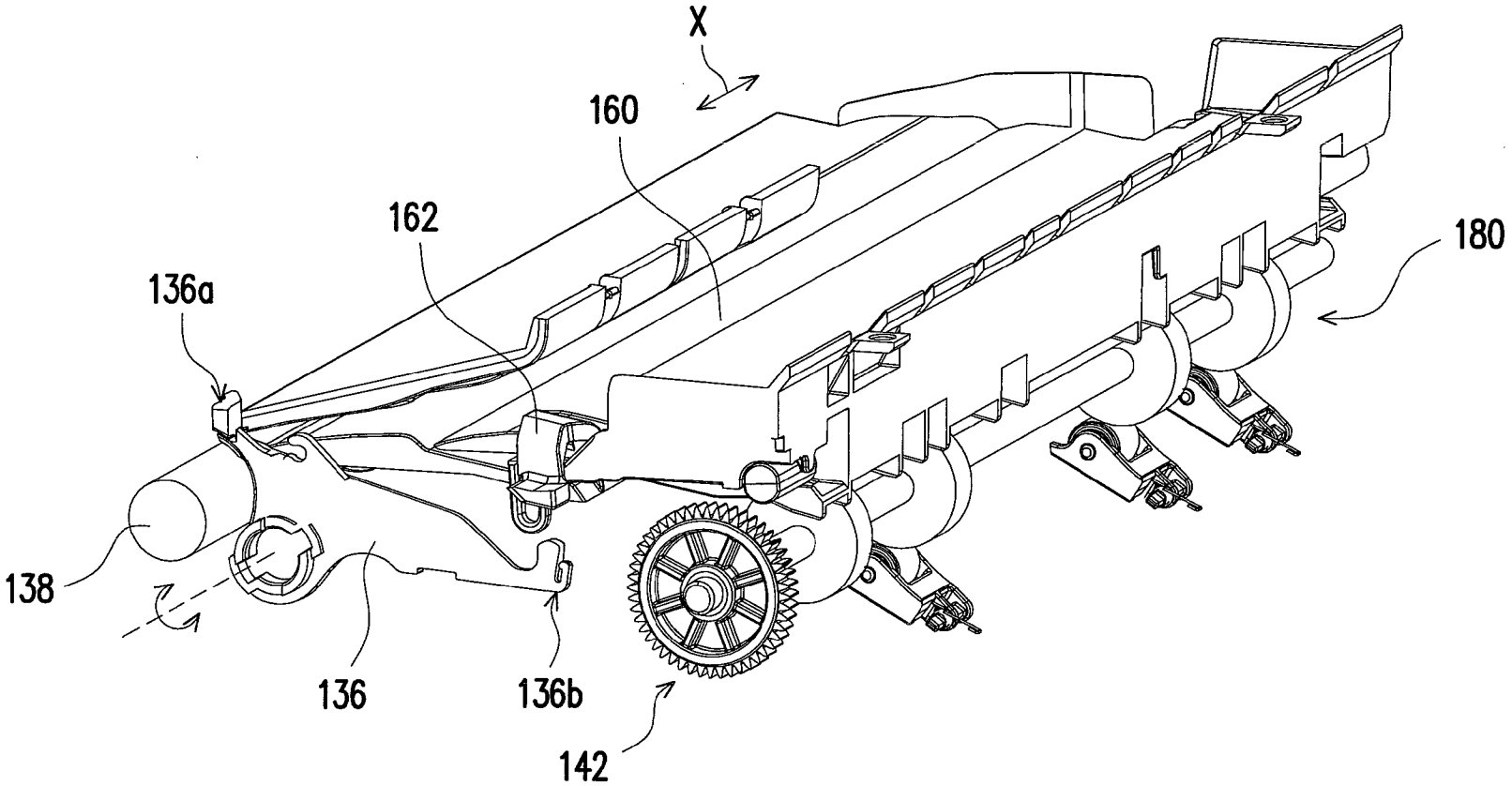
FIG. 8 is a schematic view illustrating some elements of the peripheral device depicted in FIG. 3.

FIG. 8 is a schematic view illustrating some elements of the peripheral device depicted in FIG. 3. With reference to FIG. 7 and FIG. 8, in the present embodiment, the peripheral device 100 further includes a third feeding assembly 180 that is assembled to the body 110 and is adjacent to the feed-back tray 170. The third feeding assembly 180 serves to receive the printing medium 200 transferred by the printing roller 138 of the first feeding assembly 130 and assist the printing medium 200 in moving back to the printing zone A3 through the feed-back tray 170. Namely, when the peripheral device 100 performs the feeding job, the printing medium 200 is driven by both the first feeding assembly 130 and the third feeding assembly 180, so that the peripheral device 100 can stably perform the feeding job.

The step S620 is repeated, such that the carriage 120 and the overlying printing unit 150 performs relevant printing or image processing job on the second surface P2. After the steps S630 and S640 are implemented, the printing medium 200 on which a double-side printing job is performed is moved out of the body 110 via the outlet A2.

The determination timing in the step S630 is not limited herein; according to another embodiment not shown in the drawings, whether to perform the double-side printing job may be determined before the printing job is started, and subsequent steps required for double-side printing or single-side printing are directly performed.

Plural sensors may also be configured on the feeding path or the feed-back path in the peripheral machine 100, so as to ensure implementation of each of the aforesaid steps.

Figure 9:
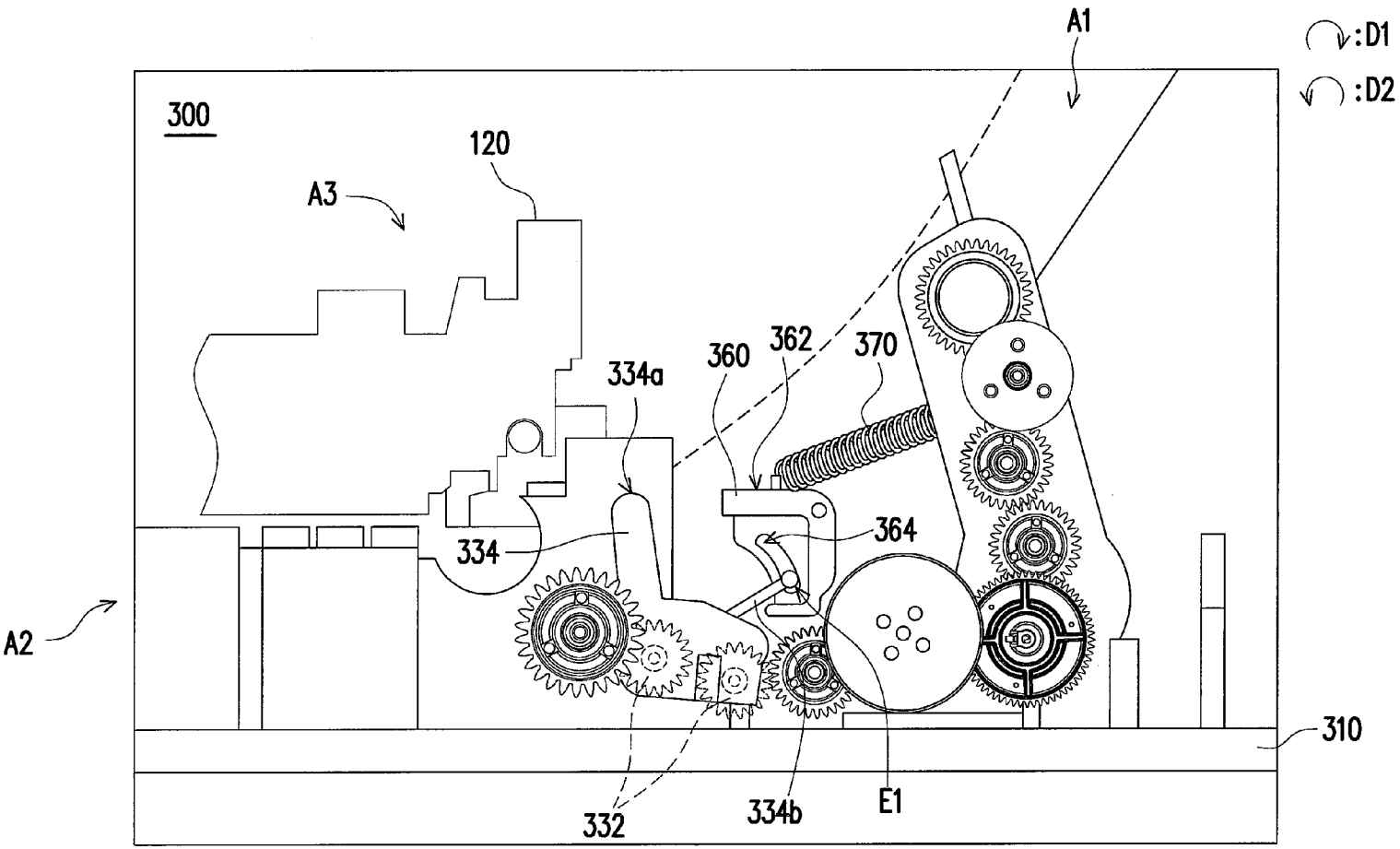
FIG. 9 and FIG. 10 are partial side views illustrating a peripheral device in a different state according to another embodiment of the invention.
Figure 10:
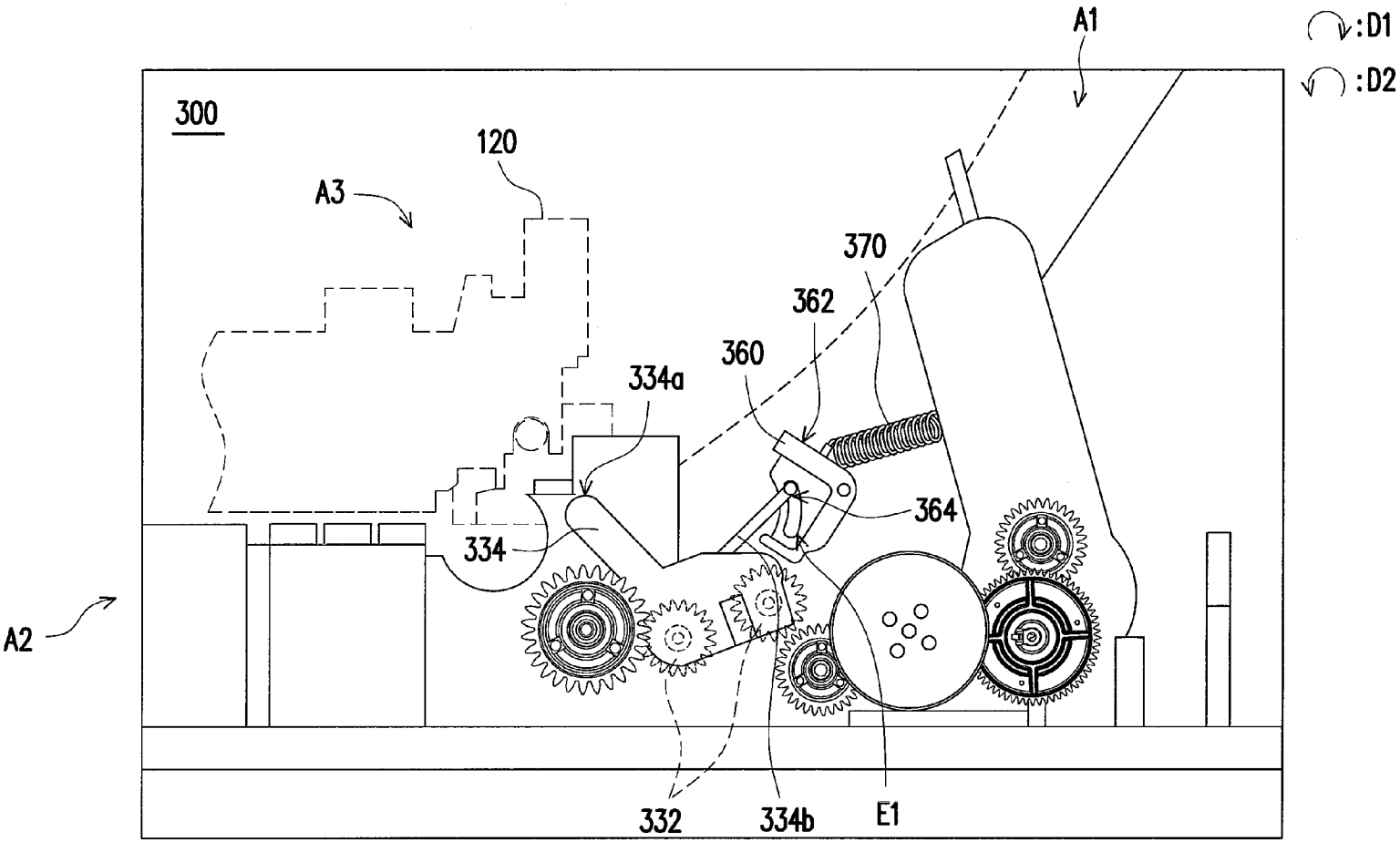

FIG. 9 and FIG. 10 are partial side views illustrating a peripheral device in a different state according to another embodiment of the invention. The location of the carriage in FIG. 9 and FIG. 10 and the location of the carriage in FIG. 4 and FIG. 5 are shown in the similar manner. Besides, some components are omitted in the drawings, so as to clearly illustrate the components to be described in the present embodiment. With reference to FIG. 9 to FIG. 10, in the peripheral device 300 described in the present embodiment, the door 360 is movably pivoted to the body 310, and a surface 362 of the door 360 facing the inlet A1 is connected to the body 310 via a spring 370. Namely, when no external force is exerted on the door 360 in an initial state, the inlet A1 is closed due to a pull force of the spring 370, as shown in FIG. 10, so as to block the printing medium 200 (shown in FIGS. 1 and 2).

The first feeding assembly 330 and the second feeding assembly 340 are located at the same side of the body 310. Here, the first feeding assembly 330 includes a first gear set 332 and a swinging element 334 pivoted to the body 110 respectively. Similar to the previous embodiments, the present embodiment discloses that the swinging element 334 partially interferes with the side surface of the first gear set 332. Hence, when the first gear set 332 rotates, the swinging element 334 is correspondingly rotated in the first direction D1 and joined to the second feeding assembly 340.

Note that the swinging element 334 has a second propping end 334*a* that extends toward the printing zone A3 and is located on the moving path of the carriage 120. The swinging element 334 further has a second arm 334*b* that extends toward the door 360 and is slidably configured in an arc-shaped sliding slot 364 of the door 360. When the swinging element 334 is swung, a sliding path of the second arm 334*b* complies with the profile of the arc-shaped sliding slot 364. When the swinging element 334 is driven by the first gear set 332 and jointed to the second feeding assembly 340, the second arm 334*b* of the swinging element 334 is slid along the arc-shaped sliding slot 364 and props the end E1 of the arc-shaped sliding slot 364, and the second arm 334*b* applies a force to swing the door 360 in the second direction D2 and lengthen the spring 370. Thereby, the door 360 can open the inlet A1 for performing the feeding job and the printing job. Similarly, the swing movement of the swinging element 334 corresponding to the timing at which the door opens or closes the inlet A1 is not limited in the present embodiment.

From another perspective, the swinging element 334 described in the present embodiment can be regarded as a lever structure, and the second propping end 334*a* and the second arm 334*b* of the swinging element 334 are located at two respective sides of the lever structure. When the carriage 120 is moved to a side of the body 110 (as described in step S650 of the previous embodiment), the carriage 120 interferes with the second propping end 334*a* and rotates the swinging element 334 in the second direction D2 by propping the second propping end 334*a*. At this time, the second arm 334*b* of the swinging element 334 is moved in the second direction D2 away from the end E1 of the arc-shaped sliding slot 364. Therefore, the door 360 on which no force is exerted returns to its initial state and again closes the inlet A1.

In the peripheral device 300 of the present embodiment, each feeding step for double-side printing described in the previous embodiment can be implemented on account of the structural relationship between the first feeding assembly 330 and the door 360. Therefore, the effects achieved in the previous embodiment can also be accomplished in the present embodiment.

To sum up, as provided in the previous embodiments of the invention, before the carriage performs a printing job, the carriage is moved, such that the peripheral device is shifted between a coupling mode and a non-coupling mode (whether the first and second feeding assemblies are coupled or not) and can then perform a feed-back job. Thereby, the double-side printing job can be completed with the existing components in no need of configuring other feed-back mechanisms. As a result, the operation efficiency of the OA equipment can be enhanced, and the manufacturing costs of the OA equipment can be reduced due to the simplified structure.

It will be apparent to those skilled in the art that various modifications and variations can be made to the structure of the disclosed embodiments without departing from the scope or spirit of the invention. In view of the foregoing, it is intended that the invention cover modifications and variations of this invention provided they fall within the scope of the following claims and their equivalents.

What is claimed is:

1. A peripheral device comprising:

a body;

a carriage assembled to the body and moved back and forth along an axial direction;

a first feeding assembly disposed at a side of the body, a portion of the first feeding assembly being located on a moving path of the carriage; and a second feeding assembly disposed at the side of the body, the first feeding assembly being removably coupled to the second feeding assembly and driving the second feeding assembly to move a printing medium into or out of the body, wherein when the carriage is moved to the side of the body, the carriage moves the first feeding assembly away from the second feeding assembly, such that the printing medium is fed into or moved out of the body simply by the first feeding assembly, wherein the first feeding assembly comprises a first gear set and a swinging element pivoted to the body respectively, the second feeding assembly comprises a second gear set pivoted to the body, the swinging element at least partially interferes with a side surface of the first gear set, the first gear set rotates to swing the swinging element in a first direction, and the swung swinging element is coupled to the second gear set and rotates the second gear set.

2. The peripheral device as recited in claim 1, the first feeding assembly further comprising:

a clutch element pivoted to the body, the clutch element having a first propping end and a leaning end opposite to each other, the swinging element having a first arm extending toward the clutch element, the first propping end being located on the moving path of the carriage, the first arm slidably leaning against the leaning end, wherein when the carriage is moved to the side of the body, the carriage props the first propping end, such that the leaning end lifts the first arm and rotates the swinging element in a second direction, and that the first gear set is moved away from the second gear set, the first direction being opposite to the second direction.

3. The peripheral device as recited in claim 2, wherein the clutch element and the swinging element are rotated in a same direction.

4. The peripheral device as recited in claim 2, further comprising:

a door movably disposed at an inlet of the body, the door being partially located on a moving path of the leaning end, the clutch element being rotated in the second direction to drive the door to open or close the inlet.

5. The peripheral device as recited in claim 1, wherein the swinging element has a second propping end away from the second feeding assembly, the second propping end being located on the moving path of the carriage, when the carriage is moved to the side of the body, the carriage props the second propping end to rotate the swinging element in a second direction, and the swinging element moves the first gear set away from the second gear set, the first direction being opposite to the second direction.

6. The peripheral device as recited in claim 5, further comprising:

a door movably disposed at an inlet of the body; and an elastic element connected between the door and the body, the elastic element driving the door to close the inlet.

7. The peripheral device as recited in claim 6, wherein the door has a sliding slot located at the side of the body, the swinging element further has a second arm opposite to the second propping end, the second arm is slidably coupled to the sliding slot, when the swinging element is rotated in the first direction, the second arm is moved to an end of the sliding slot and props the door, such that the door opens the inlet, and when the swinging element is rotated in the second direction, the second arm is moved away from the end of the sliding slot and releases the door, such that the door is driven by the elastic element to close the inlet.

8. The peripheral device as recited in claim 1, further comprising:

a feed-back tray detachably assembled to the body; and a third feeding assembly assembled to the body, the third feeding assembly being adjacent to the feed-back tray, the printing medium being driven merely by the first feeding assembly and transferred from the body back to the tray, the third feeding assembly assisting the printing medium in moving within the tray.

9. A sheet feeding method suitable for a peripheral device to print on both sides of a printing medium, the peripheral device comprising a body, a carriage, a first feeding assembly, a second feeding assembly, a printing unit, and a feed-back tray, the carriage, the first feeding assembly, and the second feeding assembly being assembled to the body, the printing unit being configured on the carriage, the tray being detachably assembled to the body, the carriage being moved back and forth along an axial direction, the first feeding assembly and the second feeding assembly being located at a side of the body, the first feeding assembly being removably coupled to the second feeding assembly, the first feeding assembly comprising a first gear set pivoted to the body, a swinging element, and a printing roller connected to the first gear set, the second feeding assembly comprising a second gear set pivoted to the body and a pickup roller connected to the second gear set, the swinging element partially interferes with a side surface of the first gear set, the sheet feeding method comprising:

moving the carriage to the side of the body, such that the carriage is driven to move the first feeding assembly away from the second feeding assembly;

moving the carriage to away from the side of the body, such that the first feeding assembly is coupled to the second feeding assembly;

rotating the first gear set to swing the swinging element toward the second gear set, such that the first gear set is coupled to the second gear set and drives the second gear set, and that the pickup roller is driven to feed the printing medium into the body;

rotating the first gear set and driving the carriage and the printing unit to drive the printing roller, such that the printing roller is driven to transfer the printing medium, and that the printing unit prints on a first surface of the printing medium;

after the carriage moves the first feeding assembly away from the second feeding assembly, rotating the first gear set to move the printing medium through the body, the feed-back tray, and the body, such that a second surface of the printing medium faces the printing unit, and that the first surface is opposite to the second surface;

after the first feeding assembly is coupled to the second feeding assembly, driving the printing unit to print on the second surface; and driving the first feeding assembly and the second feeding assembly to move the printing medium out of the body.

10. The sheet feeding method as recited in claim 9, wherein the first feeding assembly further includes a clutch element pivoted to the body, the clutch element has a first propping end and a leaning end opposite to each other, the swinging element has a first arm extending toward the clutch element, the first propping end is located on the moving path of the carriage, the first arm slidably leans against the leaning end, and the sheet feeding method further comprises:

moving the carriage to the side of the body and propping the first propping end of the clutch, such that the leaning end rotates the first arm in the second direction, and that the swinging element is moved away from the second gear set.

11. The sheet feeding method as recited in claim 10, wherein the peripheral device further includes a door movably disposed at an inlet of the body, the door is partially located on a moving path of the leaning end, and the sheet feeding method further comprises:

driving the door by the leaning end to open or close the inlet when the leaning end rotates the first arm in the second direction.

12. The sheet feeding method as recited in claim 9, wherein the swinging element has a second propping end located on the moving path of the carriage, and the sheet feeding method further comprises:

moving the carriage to the side of the body and propping the second propping end of the swinging element to rotate the swinging element in the second direction, such that the first gear set is moved away from the second gear set.

13. The sheet feeding method as recited in claim 12, wherein the peripheral device further includes a door and an elastic element, the door is movably disposed at an inlet of the body and is partially located on a moving path of the swinging element, the elastic element is connected between the door and the body and drives the door to close the inlet, and the sheet feeding method further comprises:

driving the first gear set to rotate the swinging element in the first direction, such that the swinging element drives the door to open or close the inlet; and driving the first gear set to rotate the swinging element in the second direction, such that the swinging element drives the door to close or open the inlet.

* * * * *